US009482059B2

(12) United States Patent
Legras

(10) Patent No.: US 9,482,059 B2
(45) Date of Patent: Nov. 1, 2016

(54) JUMPER SUPPORT ARRANGEMENTS FOR HYBRID RISER TOWERS

(71) Applicant: Acergy France SAS, Suresnes (FR)

(72) Inventor: Jean-Luc Bernard Legras, La Ciotat (FR)

(73) Assignee: Acergy France SAS, Suresnes (FR)

( * ) Notice: Subject to any disclaimer, the term of this patent is extended or adjusted under 35 U.S.C. 154(b) by 0 days.

(21) Appl. No.: 14/395,443

(22) PCT Filed: Apr. 15, 2013

(86) PCT No.: PCT/IB2013/001128

§ 371 (c)(1),
(2) Date: Oct. 17, 2014

(87) PCT Pub. No.: WO2013/156864

PCT Pub. Date: Oct. 24, 2013

(65) Prior Publication Data

US 2015/0101819 A1 Apr. 16, 2015

(30) Foreign Application Priority Data

Apr. 18, 2012 (GB) ..... 1206789.8

(51) Int. Cl.
*E21B 17/01* (2006.01)

(52) U.S. Cl.
CPC ..... *E21B 17/012* (2013.01)

(58) Field of Classification Search
CPC ..... E21B 17/012; E21B 17/017
USPC ..... 166/350; 405/171
See application file for complete search history.

(56) References Cited

U.S. PATENT DOCUMENTS

| | | | | |
|---|---|---|---|---|
| 4,182,584 | A | 1/1980 | Panicker et al. | |
| 4,400,109 | A | 8/1983 | Gentry et al. | |
| 4,490,073 | A | 12/1984 | Lawson | |
| 5,957,074 | A * | 9/1999 | de Baan | B63B 21/50 114/230.12 |
| 6,321,844 | B1 | 11/2001 | Thiebaud et al. | |
| 6,461,083 | B1 | 10/2002 | Pionetti et al. | |
| 7,934,560 | B2 | 5/2011 | Roveri et al. | |
| 2004/0129425 | A1 | 7/2004 | Wilson | |
| 2008/0056826 | A1 | 3/2008 | Luppi | |
| 2011/0226484 | A1 | 9/2011 | Lavagna | |

FOREIGN PATENT DOCUMENTS

| | | |
|---|---|---|
| WO | WO 87/01747 | 3/1987 |
| WO | WO 00/49267 | 8/2000 |
| WO | WO 01/30646 | 5/2001 |
| WO | WO 02/053869 | 7/2002 |
| WO | WO 03/031765 | 4/2003 |
| WO | WO 03/070561 | 8/2003 |
| WO | WO 2011/099852 | 8/2011 |

* cited by examiner

*Primary Examiner* — Matthew R Buck
*Assistant Examiner* — Patrick Lambe
(74) *Attorney, Agent, or Firm* — Levy & Grandinetti

(57) ABSTRACT

A hybrid riser tower is disclosed with a rigid riser column and a buoyancy tank positioned to apply tension to the riser column by buoyant upthrust when the tower is in an upright orientation for use. At least one jumper support structure is attached to a side of the buoyancy tank between upper and lower ends of the buoyancy tank when the tower is oriented for use. At least one riser connection extends outside the buoyancy tank from a riser pipe of the riser column to the jumper support structure, where it connects to a flexible end fitting carried by the jumper support structure. The riser connection splays laterally moving from the riser pipe toward the jumper support structure.

12 Claims, 3 Drawing Sheets

JUMPER SUPPORT ARRANGEMENTS FOR HYBRID RISER TOWERS

This invention relates to subsea risers, as used in the oil and gas industry to transport well fluids from the seabed to a surface installation such as an FPSO vessel or a platform. The invention relates particularly to hybrid riser towers and more particularly to jumper pipe support arrangements for such towers.

Hybrid riser systems have been known for many years in the development of deepwater and ultra-deepwater fields. They comprise a subsea riser support extending from a seabed anchor to an upper end held in mid-water by the upthrust of a buoyancy tank, at a depth below the influence of likely wave action. A depth of 70 m to 250 m is typical for this purpose but this may vary according to the sea conditions expected at a particular location.

An example of a hybrid riser systems a hybrid riser tower or 'HRT'. A 'bundle HRT', abbreviated to 'BHRT', is used for example in the Girassol and Greater Plutonio field developments lying in approximately 1200 m to 1500 m of water off Angola. A BHRT has rigid riser pipes extending upwardly from the seabed as an upright bundle of generally parallel pipes defining a riser column. The riser column is pivotably attached to its anchor and is held in tension by a buoyancy lank at its upper end.

Flexible jumper pipes hanging as catenaries extend from the upper end of the riser column to an FPSO or other surface installation. The jumper pipes add compliancy that decouples the rigid riser pipes from surface movement induced by waves and tides. The riser pipes experience less stress and fatigue as a result.

Umbilicals and other pipes generally follow the paths of the riser pipes and the jumper pipes to carry power, control data and other fluids. As a result, the bundle in the riser column may comprise some pipes used for oil production, some pipes used for injection of water and/or other fluids, some gas-lift lines and/or some other pipes used for oil and gas export. Those pipes are generally clustered around a central core. The pipes of the riser column wilt generally serve as flowlines, which in this specification is simply intended to mean a line arranged to convey fluids. The central core may also serve as a flowline to convey fluids along the riser column although the central core is more typically a hollow, solely structural tube or pipe.

The rigid risers and the core pipe are most commonly of steel, which may be coated or sleeved with, for example, a polypropylene (PP) coating for corrosion protection and for insulation.

Thus, from bottom to top, a BHRT typically comprises a foundation in the seabed; an articulated joint; a bundle of pipes including rigid risers and a structural core pipe; a buoyancy tank at the top of the bundle; a jumper support structure and flexible jumpers to connect with a floating production unit.

Buoyancy is required to support a BHRT in different orientations, particularly in a generally horizontal orientation when being fabricated and towed to an installation site and in an upright, substantially vertical orientation when in operation.

When a BHRT has been upended for use, a buoyancy tank at the upper end of the riser column applies upthrust that keeps the riser column in tension. Supplementary buoyancy modules of syntactic foam may be distributed at intervals along the riser column to support the riser column when it is horizontal during fabrication, towing and installation. Any such supplementary buoyancy modules apply additional upthrust to the riser column after upending; they may also guide, retain and/or insulate the pipes in the riser column.

In prior art BHRTs, the buoyancy tank is typically part of the riser column, being in effect it with the top of the riser column by being rigidly connected to one or more rigid elements of the BHRT bundle. Also, the flexible jumper pipes are supported at the top of the buoyancy tank and rigid riser connections are routed through the tank to be supported also at the top of the tank. This configuration complicates the design of the buoyancy tank and increases bending moments applied to the BHRT bundle during installation and in service.

Examples of BHRTs of this general type are disclosed in U.S. Pat. No. 4,182,584 to Mobil Oil, in WO 02/053869 to Stolt Offshore, in U.S. Pat. No. 6,321,844 to Stolt Comex Seaway and Doris Engineering, in WO 00/49267 to Bouygues Offshore (also published as U.S. Pat. No. 6,461,083), in WO 03/070561 to Magnussen and in US 2008/0056826 to Luppi.

U.S. Pat. No. 7,934,560 to Petrobras discloses a self-supported riser tower without a separate structural core pipe. Again, the flexible jumper pipes and the rigid riser pipes are supported at the top of the buoyancy tank.

WO 87/01747 to Horton discloses a compliant ten on-type riser tower that does not face the problems addressed by the invention but again, the flexible jumper pipes are supported at the top of the buoyancy tank.

WO 03/0031765 to Subsea 7 discloses flexible jumper pipes coupled at right angles to respective rigid pipes of a hybrid riser, emerging at intervals along the length of a buoyancy unit.

WO 2011/099852 to Heerema discloses a riser tower in which rigid riser pipes extend outside a buoyancy unit to jumper support structures attached to sides of the buoyancy unit. Riser connections positioned outside the buoyancy unit extend from the riser pipes to jumper pipes carried by the jumper support structures. However, the jumper pipes are supported level with the top of the buoyancy unit.

It is against this background that the present invention has been devised.

Broadly, the invention relates to a hybrid riser tower comprising a rigid riser column and a buoyancy unit positioned to apply tension to the riser column by buoyant upthrust when the tower is in an upright orientation for use. The invention resides it two or more jumper support structures angularly spaced around a central longitudinal axis of the tower that are each attached to a side of the buoyancy unit disposed between upper and lower ends of the buoyancy unit when the tower is oriented for use. The jumper support structures support end fittings of jumper pipes at a level between the upper and lower ends of the buoyancy unit. Riser connections extend outside the buoyancy unit from riser pipes of the riser column to the jumper support structures.

The buoyancy unit may have buoyant elements above and below the level of the end fittings when the buoyancy unit is oriented for use.

The side of the buoyancy unit may be a side structure such as a side wall. Where each jumper support structure is attached to or through a side wall, that wall is suitably upright when the tower is oriented for use.

Advantageously, each riser connection may connect to flexible end supported by one of the jumper support structures.

The riser connections may splay laterally moving from the riser pipes toward the jumper support structures; also, the riser connections may curve from the riser pipes beyond the jumper support structures before converging with the jumper support structures, for example in a goose-neck shape.

Jumper support structures may mutually opposed, extending away from the buoyancy unit in aligned but opposite lateral directions generally orthogonal to the centre longitudinal axis of the tower.

The tower of the invention may beneficially be arranged such that a centre of action of jumper pipes supported by the jumper support structures crosses a net buoyancy load vector of the buoyancy unit.

The buoyancy unit preferably comprises one or more gas-fillable buoyancy compartments and one or more buoyancy blocks of foam. One or more buoyancy blocks may be disposed at the upper and/or lower ends of the buoyancy unit. This enables an advantageous method within the same inventive concept, namely a method of optimising bending moments applied to a hybrid riser tower of the it by adjusting distribution of buoyancy between the upper and tower ends of the buoyancy unit.

In summary, the invention allows the elevation of the jumper pipe ends to be optimised to facilitate the equilibrium of loads applied on the to of the BHRT column and to minimise the be moment applied by the buoyancy unit to the riser bundle. This may be achieved by providing a jumper support structure on one or more sides of the integral buoyancy unit there need be no jumper support structures at the upper or lower ends of the buoyancy unit, although this remains possible if the desired position of the jumper pipe ends can be achieved. The rigid risers of the bundle are supported below the buoyancy unit and riser connections between the top of the bundle and the jumper structure are conveniently routed on the outside of the buoyancy unit.

The invention provides a cost-effective solution that reduces extreme moments and fatigue loading on the top of the BHRT bundle; it also avoids the complexity of routing risers through the buoyancy unit.

In order that the invention may be more readily understood, reference now be made, by way of example, to the accompanying drawings in which.

Figure 1:
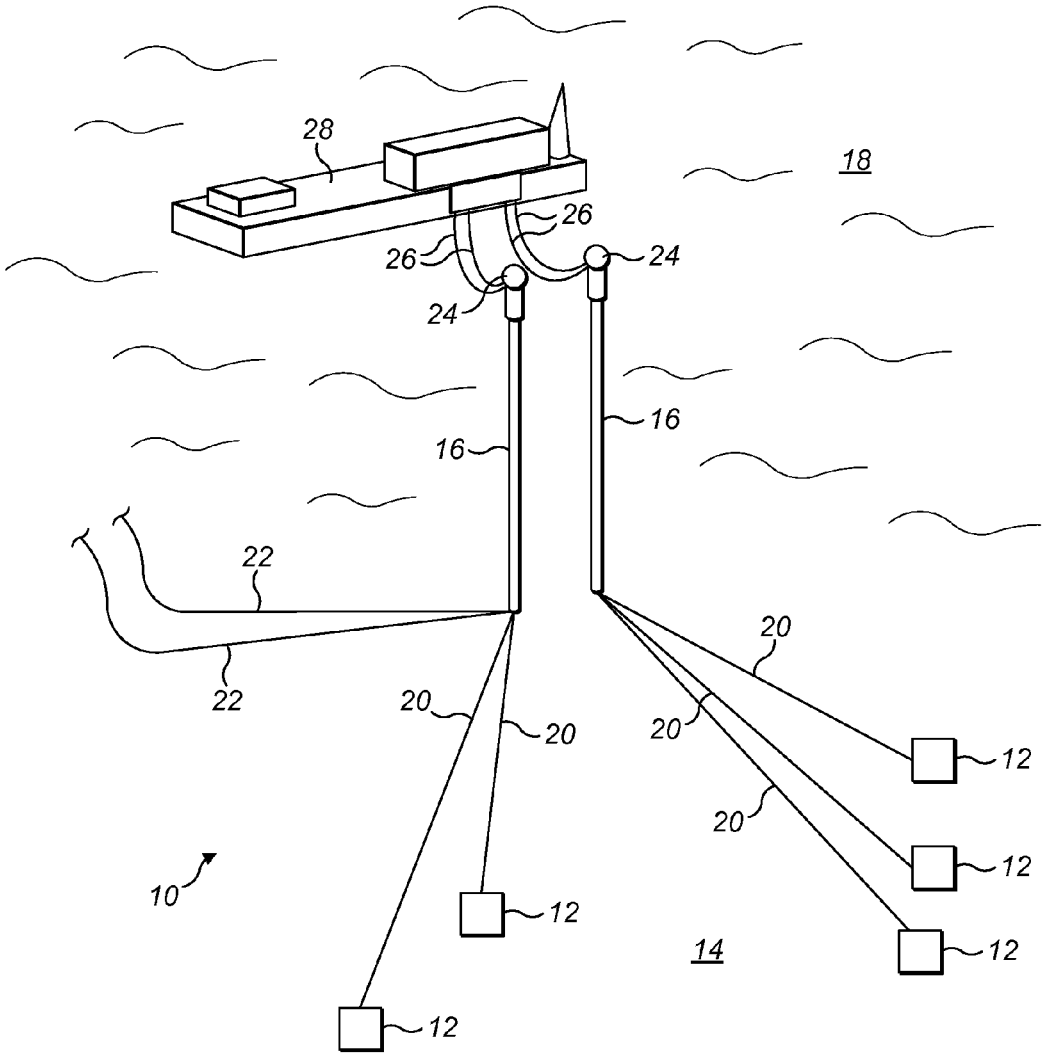
FIG. 1 Prior Art
FIG. 1 is a much-simplified schematic perspective view of a prior art subsea oil-production installation including HRTs, to put the invention into context.

Referring firstly to FIG. 1 to illustrate the general principle of a prior art HRT, this shows a subsea oil-production installation 10 comprising well heads, injection sites, manifolds and other pipeline equipment generally designated 12 located on the seabed 14 in an oil field. This drawing is not to scale: in particular, the water depth will be very much greater in practice than is suggested here.

Upright HRTs 16 convey production fluids from the seabed 14 to the surface 18 and convey lifting gas, injection water and treatment chemicals such as methanol from the surface 18 to the seabed 14. For this purpose, the base of each HRT 16 is connected to various wall heads and injection sites 12 by horizontal pipelines or spools 20. Further spools 22 optionally connect to other well sites elsewhere on the seabed 14.

The HRTs 16 are pr fabricated at shore facilities, towed horizontally to their operating location and then upended and installed on the seabed 14 with an anchor at the bottom and buoyancy at the lop provided by a buoyancy tank 24. The buoyancy tank 24 imparts tension to the riser column of the HRT 16.

Each HRT 16 comprises a bundle of pipes defining separate but parallel conduits for the various fluids that those pipes carry individually. Most or all of those pipes will typically be of steel. One or more of the pipes will be a structural core tube that may or may not also serve as a flowline.

Flexible jumper pipes 26 extend in a catenary configuration from the riser column of each HRT 16 to a floating production, storage and offloading (FPSO) vessel 28 moored nearby at the surface 18. The FPSO vessel 28 provides production facilities and storage for the fluids coming from and going to the seabed equipment 12.

The prior art proposals identified in the introduction generally support their jumper pipes at the top of the buoyancy tank. Reflecting another approach known in the art, the jumper pipes 26 shown in FIG. 1 are supported at the bottom of each buoyancy tank 24.

Figure 2:
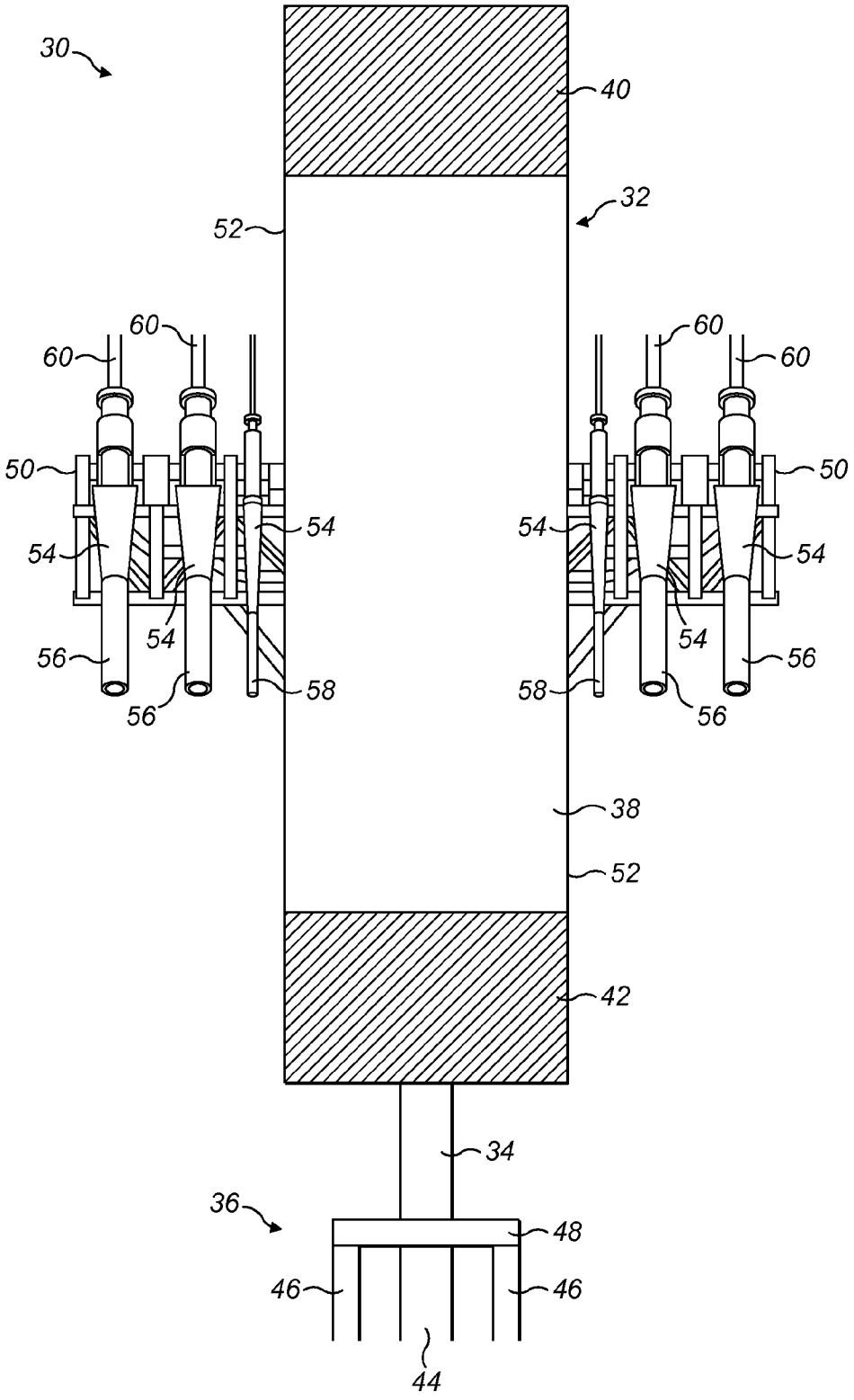
FIG. 2 is a schematic front view, not to scale, of the top region of a BHRT modified in accordance with the invention.

Referring now to FIG. 2, a BHRT column 30 in accordance with the invention comprises a buoyancy tank 32 rigidity coupled by a rigid structural link 34 to a rigid riser bundle 36. The riser bundle 36 extends down to near the seabed and only the top of the riser bundle 36 can be seen in this view.

The buoyancy tank 32 and the riser bundle 36 are aligned on a common central longitudinal axis in structural terms, the buoyancy tank 32 is effectively integral with the riser bundle 36.

The buoyancy tank 32 is a slender, long cylinder having a central portion 38 comprising multiple buoyancy compartments for redundancy in case of flooding. Typically the buoyancy compartments are stacked one above another in the central portion although they could be arranged side-by-side.

The buoyancy tank 32 further comprises top end bottom blocks of syntactic foam 40, 42 respectively above and below the central portion 38. The foam blocks 40, 42 provide buoyancy during towing to the installation site, enabling the buoyancy compartments of the central portion 38 to remain flooded with water during towing and installation. Where the buoyancy compartments are flooded, there be no adverse consequence if the buoyancy tank 32 should sink deeper than expected during installation; there is therefore no need to use a safety buoy.

After the upending phase of installation, the upthrust of the buoyancy tank 32 is increased to apply tension to the riser bundle 36 by injecting pressurised gas to displace water from the buoyancy compartments of the central portion 38.

The riser bundle 36 comprises a rigid core tube 44 and parallel rigid riser pipes 46 surrounding the core tube 44, joined to the core tube 44 by a hang-off table 48 positioned just below the bottom foam block 42 of the buoyancy tank 32. The hang-off table 48 extends in opposite lateral directions and lies generally in a pine orthogonal to a central longitudinal axis of the core tube 44. The hang-off table 48 bears the weight of the riser pipes 46 hanging toward the seabed.

The core tube 44 extends upwardly to the bottom of the buoyancy tank 32, where it is rigidly connected to the steel structure of the buoyancy tank 32. Conveniently for this purpose, the core tube 44 is aligned with and extends into a central tubular structural member of the buoyancy tank 32, typicality via a taper joint that tapers downwardly from the relatively wide structure of the buoyancy tank 32 to the relatively narrow core tube 44. Such a taper joint is well known in the art and has been omitted from the drawings for simplicity.

Two riser pipes 46 are shown in the simplified view of FIG. 2 but in practice there will be additional flowline pipes and also other elongate elements such as umbilicals or cables in the riser bundle 36. Also, in practice, guide frames—which cannot be seen in this view—will be distributed along the riser bundle 36 to locate the riser pipes 46 relative to the core tube 44. The riser pipes 46 may be insulated, non insulated or of pipe-in-pipe (PiP) construction.

In accordance with the invention, jumper support structures 50 are positioned by suitable connections to sides of the structure of the buoyancy tank 32. In this simplified view, the jumper support structures 50 are shown attached to side waits 52 of the buoyancy tank 32. However, those skilled in the art will appreciate that the side walls 52 of the buoyancy tank 32 may, in practice, be merely skins. In that case, internal structural members of the buoyancy tank 32 may reinforce the side walls 52 or the jumper support structures 50 may extend inboard of, or through, the side walls 52 to be supported by internal structural members of the buoyancy tank 32.

In this example, the jumper support structures 50 are elongate lattice members that are mutually opposed at the same level mid-way along the height of the side walls 52, extending away from the buoyancy tank 32 in aligned but opposite lateral directions orthogonal to a central longitudinal axis of the buoyancy tank 32. There may be any suitable number of jumper support structures 50 and there need not be equal number of them, but it is preferred that they are distributed equi-angularly around the buoyancy tank 32 to balance the loads that they impart to the buoyancy tank 32.

The jumper support structures 50 support an array of, flexible end fittings 54 from which flexible jumper pipes 56 and umbilicals 58 sweep downwardly at the start of to their catenary curve to the surface. The number of flexible end fittings 54 exceeds the number of riser pipes 56 in the simplified schematic view of FIG. 2; in practice, however, there would be as many flexible end fittings 54 as there are riser pipes 46 and other elements such as umbilicals 58 in the riser bundle 36.

Figure 3:
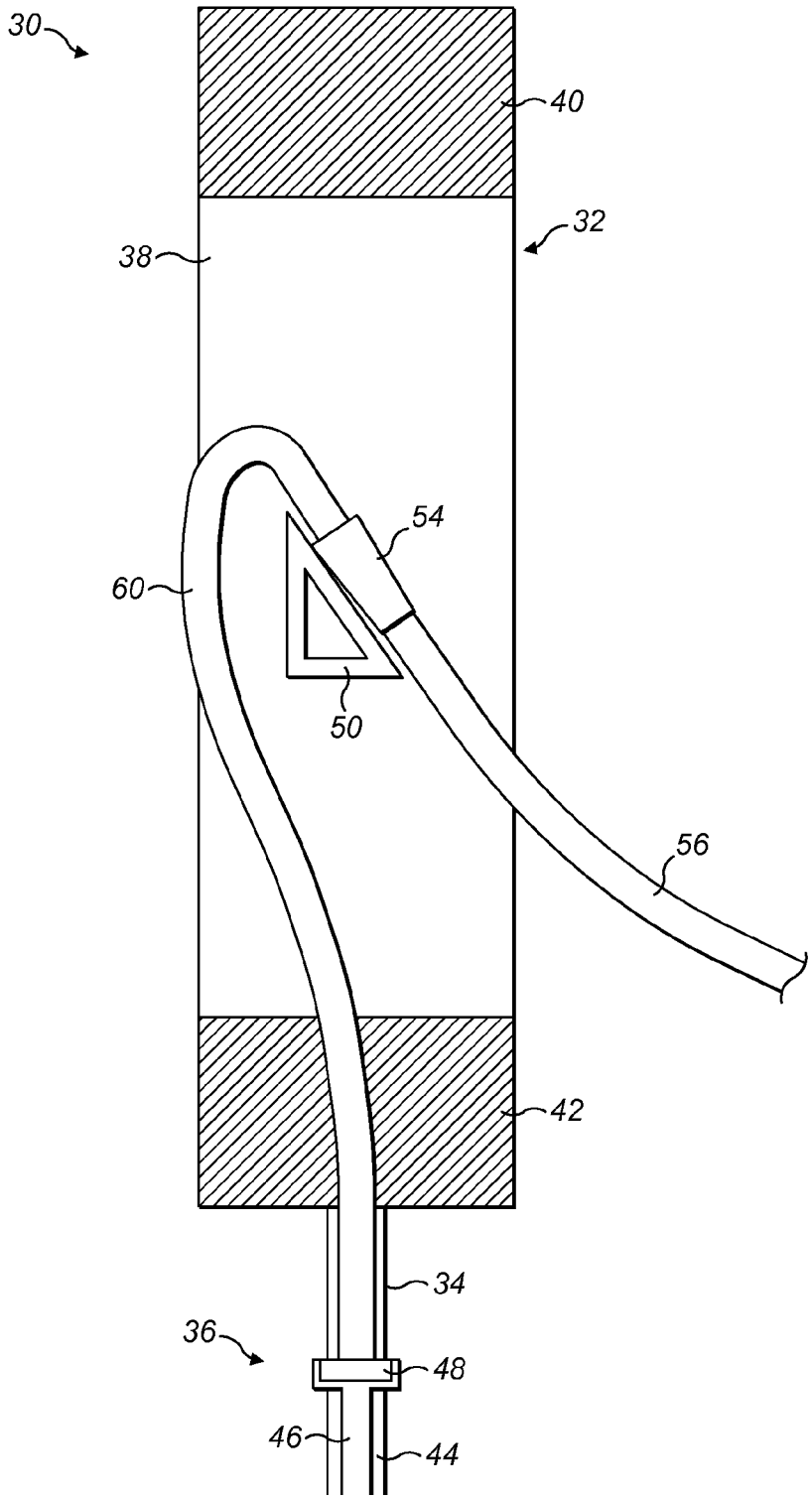
FIG. 3 is a schematic side view corresponding to FIG. 2 and also not to scale.

As best shown in FIG. 3, riser connections 60 disposed beside the buoyancy tank 32 extend to the flexible end fittings 54 from the riser pipes 46. In the simplified schematic view of FIG. 3, a riser connection 60 is shown extending only from one riser pipe 46 but in practice similar parallel connections will also extend as a manifold from other riser pipes 46 and from other elements of the riser bundle 36 such as umbilicals.

The riser connections 60 have a 'goose-neck' shape in the example of FIG. 3. The riser connections 60 curve above the flexible end fittings 54 to incline downwardly as they approach the flexible end fittings 54, in approximate alignment with the downward departure angle of the flexible jumper pipes 56 from the jumper support structures 50. This curvature and inclination reduces stress under thermal to ding and under forces imparted via the jumper pipes 56 and the umbilicals 58 under the action of waves and currents.

As FIG. 3 shows, the riser connections 60 pass around the sides, of the buoyancy tank 32 to the flexible end fittings 54 rather than extending through the buoyancy tank as in the prior art. To do so, the riser connections 60 splay laterally moving upwardly from the riser bundle 36 toward the buoyancy tank 32, as the riser bundle 36 is generally narrower than the buoyancy tank 32. More specifically, riser pipes 46 of the riser bundle 36 will generally lie closer than the side walls 52 of the buoyancy tank 32, and hence than the flexible end fittings 54, to the central longitudinal axis of the BHRT column 30.

The side-of-tank positioning of the jumper support structures 50 has various Advantages. For example, in the in-place configuration after the riser bundle 36 has been upended, the centre of action of the jumper pipes 56 (in an average configuration) can cross exactly the net buoyancy load vector of the buoyancy tank 32. This means that bending moments applied by the jumper pipes 56 to the buoyancy tank 32 are minimised. One benefit of this is that the joint below the buoyancy tank 32 connecting to the core tube 44 (typically a taper joint as noted above) can be reduced in size and cost compared to prior art arrangements that support jumpers at the top of the buoyancy tank 32. The cross section of the riser bundle 36 can start immediately below or at the bottom of the buoyancy tank 32, where the hang-off table 48 is connected to the central tubular member of the buoyancy tank 32 via the core tube 44.

In terms of in-place dynamics, the mass of the buoyancy tank 32 is centred close to the point of dynamic excitation of the jumper pipes 56. As a result, the bending modes of the BHRT column 30 are not significantly excited by motion of the jumper pipes 56 in response to waves and currents.

The moments applied to the top of the BHRT column 30 can also be minimised for towing and upending operations. The centre of buoyancy during those operations can easily be adjusted by varying the distribution of buoyancy between the top and bottom foam blocks 40, 42 of the buoyancy tank 32, simply by selecting an appropriate volume of foam for each block 40, 42. Also, a towline attachment point can be placed at an optimum location between the top of the buoyancy tank 32 and the jumper support structures 50.

The side-of-tank positioning of the jumper support structures 50 and the riser connections 60 has other advantages over prior art arrangements in which riser connections extend through the buoyancy tank to jumper pipes supported at the top or in which jumper pipes are supported at the bottom of the tank. When compared to prior art arrangements having riser connections extending through the buoyancy tank, the side-of-tank positioning has advantages for simplifying construction and installation and to a lesser extent maintenance and upgrading. When compared to prior art arrangements having riser connections below the buoyancy tank (where the tank may be connected to an upper riser termination assembly by a chain, cable or the like) then advantages reside in installation, maintenance and upgrading and to a lesser extent in construction. More generally, at the expense of slightly more complex fabrication work, the invention saves an offshore operation, namely installation of the buoyancy tank; it also saves a flex joint for the buoyancy tank.

The invention claimed is:

1. A hybrid riser tower comprising a rigid riser column that extends upwardly from a seabed anchor and is defined by a bundle of parallel riser pipes, and a buoyancy unit positioned to apply tension to the riser column by buoyant upthrust when the tower is in an upright orientation for use, wherein:

two or more jumper support structures that extend radially from the tower with respect to a central longitudinal axis of the tower are circumferentially spaced with respect to one another around the central longitudinal axis of the tower, are each attached to a side of the buoyancy unit disposed between upper and lower ends of the buoyancy unit when the tower is oriented for use, and support end fittings of jumper pipes at a level between the upper and lower ends of the buoyancy unit; and riser connections extend outside the buoyancy unit from the riser pipes of the riser column to the jumper support structures.

2. The tower of claim 1, wherein the buoyancy unit has buoyant elements above and below the level of the end fittings when the buoyancy unit is oriented for use.

3. The tower of claim 1, wherein each jumper support structure is attached to a side wall of the buoyancy unit, which wall is upright when the tower is oriented for use.

4. The tower of claim 3, wherein the end fittings of the jumper pipes are supported at a level mid-way along the height of the upright side wall.

5. The tower of claim 1, wherein each riser connection connects to an end fitting supported by one of the jumper support structures.

6. The tower of claim 1, wherein the riser connections splay laterally moving from the riser pipes toward the jumper support structures.

7. The tower of claim 1, wherein the riser connections curve from the riser pipes beyond the jumper support structures before converging with the jumper support structures.

8. The tower of claim 1, wherein the buoyancy unit comprises one or more gas-Tillable buoyancy compartments and one or more buoyancy blocks of foam.

9. The tower of claim 8, wherein one or more buoyancy blocks are disposed at the upper and/or lower ends of the buoyancy unit.

10. The tower of claim 1, wherein the jumper support structures are mutually opposed, extending away from the buoyancy unit in aligned but opposite lateral directions generally orthogonal to the central longitudinal axis of the tower.

11. The tower of claim 1 arranged such that a center of action of jumper pipes supported by the jumper support structures crosses a net buoyancy load vector of the buoyancy unit.

12. The tower of claim 1 having no jumper support structures at the upper or lower ends of the buoyancy unit.

* * * * *